US005485651A

United States Patent [19]

Payeur

[11] Patent Number: 5,485,651

[45] Date of Patent: Jan. 23, 1996

[54] VACUUM CLEANING AND SHAMPOOING SYSTEM HAVING HIGH-PRESSURE AIR MEANS

[76] Inventor: Daniel R. Payeur, 66 Old Post Rd., Sanford, Me. 04073

[21] Appl. No.: 415,174

[22] Filed: Mar. 31, 1995

Related U.S. Application Data

[63] Continuation-in-part of Ser. No. 243,258, May 16, 1994, abandoned.

[51] Int. Cl.[6] ..... A47L 5/14

[52] U.S. Cl. ..... 15/321; 15/322; 15/346; 15/398

[58] Field of Search ..... 15/345, 346, 321, 15/322

[56] References Cited

U.S. PATENT DOCUMENTS

| | | | |
|---|---|---|---|
| 2,055,577 | 9/1936 | Huff | 15/345 |
| 3,161,900 | 12/1964 | Hornschuch et al. | 15/345 |
| 3,268,942 | 8/1966 | Rossnan | 15/346 |
| 3,484,890 | 12/1969 | Case | 15/346 |
| 3,678,534 | 7/1972 | Hilbig | 15/345 |
| 3,940,826 | 3/1976 | Phillips et al. | 15/345 X |
| 4,083,077 | 4/1978 | Knight et al. | 15/322 X |
| 4,488,330 | 12/1984 | Grave | 15/322 |

FOREIGN PATENT DOCUMENTS

| | | | |
|---|---|---|---|
| 4135406 | 5/1992 | Germany | 15/346 |

*Primary Examiner*—Chris K. Moore
*Attorney, Agent, or Firm*—William Nitkin

[57] ABSTRACT

A vacuum cleaning system utilizing a small-mouthed nozzle on a vacuum hose member, such nozzle having an air outlet member disposed therein for the directing of a high-pressure air stream out of said nozzle at selected times onto the surface to be cleaned while vacuuming is occurring through said nozzle. Shampoo fluid can optionally be delivered to the surface to be cleaned with such high-pressure air stream.

8 Claims, 7 Drawing Sheets

VACUUM CLEANING AND SHAMPOOING SYSTEM HAVING HIGH-PRESSURE AIR MEANS

This application is a continuation-in-part of my previous application under the title Vacuum Cleaning System Having High-Pressure Air Means, Ser. No. 08/243,258 filed May 16 1994, now abandoned.

BACKGROUND OF THE INVENTION

1. Field of the Invention

This invention resides in the area of vacuum cleaners and more particularly relates to a hose attachment for vacuum cleaners for industrial and commercial purposes for cleaning, loosening and removing particulate matter, such as dirt, from automobile interiors and the like by providing simultaneous air agitation and high levels of suction through a small-mouthed nozzle member along with an optional carpet shampooing ability.

2. Description of the Prior Art

The prior art in this field teaches using vacuum cleaners to remove dirt and debris from carpeting and other surfaces. The prior art also teaches that loosening of such debris from the pile of carpeting can be accomplished by mechanical beating means and by directing an air stream toward the particulate matter as such debris is being vacuumed. Many devices have been patented which direct air within wide-carriage head structures of a vacuum cleaner to loosen the debris to be vacuumed while at the same time the vacuum air suction lifts the thus loosened particulate matter away. Commercial vacuum cleaners utilizing air pressure agitation to dislodge particles have heretofore been large, wide-carriage devices about one foot wide or wider adapted to quickly cover large areas of flooring to be vacuumed. Also carpet shampooing devices exist in the prior art which direct shampoo fluids to the area to be cleaned and vacuum such fluids up again.

SUMMARY OF THE INVENTION

It is an object of this invention to provide a vacuum cleaning system useful for reaching small areas and crevices such as found in automobile flooring.

It is a further object of this invention to provide a vacuum cleaning system having the optional ability to shampoo carpets.

The system of this invention is particularly useful in gasoline stations, automobile repair facilities, automobile car wash facilities and the like where high-powered vacuums are utilized to clean and shampoo the carpeting and upholstery of automobiles. Detailers of automobiles must remove even the smallest amount of dirt from out of the smallest crevices in an automobile which generally has many small areas having sharp contours which cannot be reached by traditional, large-headed vacuum cleaners.

This invention discloses an improved vacuum cleaning system with optional shampooing means utilizing the principle of having a high-pressure air stream blowing onto the surface to be cleaned to loosen the dirt while at the same time a vacuum air suction is applied within the mouth of an extremely small nozzle at the end of the hose attachment.

It is a still further object of this invention to provide an improved system of providing such high-pressure air stream to a small vacuum cleaner hose attachment nozzle which system is highly advantageous for the cleaning of automobile interiors, but which small nozzle can be used in other non-automotive situations as well. It should be noted that many facilities that deal with automobiles have sources of compressed air such as produced by a compressor in a storage tank. Such facilities may also have an industrial-grade, high-powered vacuum cleaner such as a SHOP-VAC brand vacuum cleaner having a vacuum hose of wide diameter such as a diameter of 3 inches. Automobile carpeting is especially difficult to clean because particulate debris often remains embedded in the dense carpet pile; and such debris, when vacuumed by prior art small nozzle vacuum cleaners, can be very difficult to remove. Because of the contours of automobile carpeting, it is often difficult to maneuver large prior art vacuum cleaner nozzles successfully to loosen such debris. One can try to brush the debris from such carpeting as well as try to beat the debris loose from the pile prior to vacuuming it. Because of the sharp contours and inaccessible areas of an automobile, It is impossible to use commercial, large-headed vacuum cleaners because they are too big to reach successfully into the contours of the flooring. The system of this invention utilizing a small nozzle attachment with improved structure has been developed to allow compressed air to dislodge debris on automobile carpeting and upholstery at the same time that vacuuming is occurring for highly successfully cleaning and, if desired, shampooing thereof.

It is yet a further object of this invention to provide a high-pressure air stream through an air pressure hose conveniently and compactly contained within the vacuum hose member. The air pressure hose can be made of materials that are commercially available and easily adapted for use in a garage or other automotive facility. High-pressure air is directed by an air pressure hose through a valve member to an outlet member disposed directly in the mouth of the nozzle which, in one embodiment, is spaced away from the the surface to be cleaned a distance by rollers positioned near the mouth of the nozzle which distance allows for improved air movement.

It is a further object of this invention to provide nozzles of various shapes which incorporate the principles of this invention, the shape of such nozzle to be used determined by its intended use, as well as a brush attachment for attachment at the mouth of the nozzle for use when cleaning upholstery fabric.

The structure of this invention provides for a high-pressure air outlet member to be disposed at the mouth of the nozzle with a nozzle high-pressure air line incorporated directly within both the nozzle and the vacuum hose member which structure can be interconnected to any large commercial vacuum cleaner. The vacuum hose member has contained therein for ease of use and to keep it out of the way such high-pressure air line carrying high-pressure air which line can be passed through an aperture in the vacuum hose member near its connection to the vacuum cleaner to be interconnected to a high-pressure air supply source which can be produced by means such as a tank of compressed air and the like. The high-pressure air line then extends down inside the vacuum hose member, where it does not interfere with the suction of the vacuum hose member, to the inlet of a valve member in the collar member. The collar member on its exterior surface can have manually operable means to activate an on/off valve so that high-pressure air activation can be manually controlled to have it either "on" or "off" as desired during the vacuuming process. One end of the collar member fits over the vacuum hose end member in a generally air-tight fashion by friction fit or equivalent means of attachment, and the nozzle member fits onto the other end of the collar member with a nozzle high-pressure air line disposed within the nozzle which releasably engages the outlet of the valve member in the collar member, as further described below, to allow the high-pressure air to pass through the nozzle high-pressure air line down to the high-pressure air outlet member which is disposed transversely across the mouth of the nozzle. The high-pressure air outlet member has at least one outlet aperture and in most embodiments a plurality of outlet apertures which direct the high-pressure air stream downward against, or at an angle to, the surface being vacuumed, such as carpet pile, to dislodge any dirt or other particulate matter therein while vacuuming is occurring. The mouth of the nozzle can be spaced away from the surface being vacuumed for optimum employment of the high-pressure air stream. In one embodiment of the system of this invention the high-pressure air outlet member can be a hollow, transversely disposed tube in the nozzle mouth opening with a pair of rollers rotatably disposed at the front and rear of the nozzle mouth, spacing the nozzle mouth somewhat away from the surface to be vacuumed. Such spacing is the distance that the rollers are positioned from the mouth of the nozzle and in a preferred embodiment such distance can be approximately ¼ inch away from the surface to be vacuumed. This spacing distance that the wheels protrude from the mouth of the nozzle allows for maximum air movement when using the high-pressure air stream of this invention as well as allowing the nozzle to roll easily over the surface to be vacuumed. The positioning of the two rotating rollers at the front and rear of the mouth of the nozzle and the ability to move the nozzle on the rotating rollers allows the vacuum cleaner nozzle to move easily a fixed distance above the carpeting to dislodge the particles when the air pressure valve member is activated as desired and at the same time to vacuum any dislodged dirt up inside the nozzle through the vacuum hose back to the vacuum canister. In some instances, though, the space between the nozzle and the surface to be vacuumed shold be minimized as much as possible.

Since high-pressure air passing through the plurality of outlet apertures can disturb the nap of upholstery fabric and cause high-pressure air lines to appear on the nap, a brush member can also be attached around the mouth of the nozzle, the use of which brush member can be especially useful in preventing such high-pressure air line marks from appearing on the upholstery fabric. The brush member, as described below, spaces the outlet apertures and rollers further away from the upholstery surface to avoid such problems.

In a further embodiment the system of this invention can incorporate different shaped nozzles to accomplish specific tasks, such as an elongated, extremely narrow nozzle without rollers for reaching into very narrow places. In this rollerless embodiment the high-pressure air line ends at a high-pressure air outlet member in the nozzle mouth disposed transversely across the mouth of the narrow nozzle having a plurality of outlet apertures of different sizes to balance the air flow across the nozzle mouth.

In a still further embodiment the system of this invention can also shampoo upholstery fabric and/or carpet. A bottle of shampoo fluid can be hung on the vacuum cleaner with a tube extending from within the bottle to a shampoo hose running alongside the air pressure hose within the vacuum hose member. The shampoo hose exits the collar member and is engaged into the nozzle high-pressure air line so that when high-pressure air is activated by the on/off valve, it draws the shampoo fluid into the nozzle high-pressure air line by a venturi action, as described below, and directs the shampoo fluid out the nozzle openings along with the high-pressure air. When the high-pressure air valve is biased "off," the vacuum can by suction pick up the dirt mixed with the shampoo fluid to thoroughly shampoo the fabric or carpet being cleaned.

DESCRIPTION OF THE PREFERRED EMBODIMENT(S)

Figure 1:
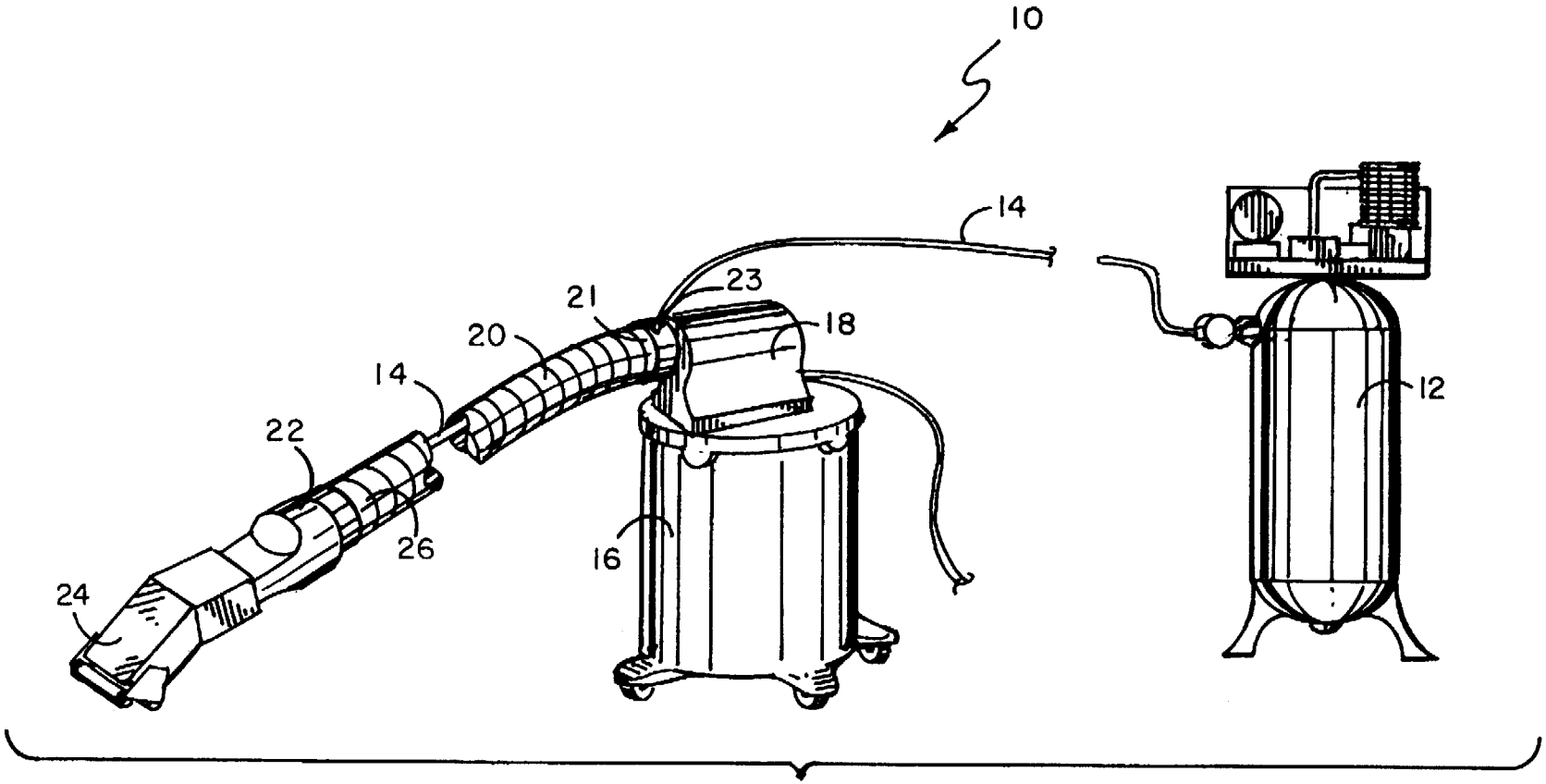
FIG. 1 illustrates a perspective view of the system of this invention.

FIG. 1 illustrates a perspective view of the generalized preferred embodiment of the vacuum cleaning system of this invention with canister-style vacuum cleaner 10 having vacuum hose member 20 extending therefrom. Such canister-style vacuum cleaners are very popular in automotive garages and in automotive cleaning establishments. A canister-style vacuum cleaner typically consists of a canister 16 having housing 18 which contains a high-powered motor, creating vacuum suction within canister 16. Vacuum housing aperture 21 is disposed in housing 18 into which vacuum hose member 20 is inserted. In the system of this invention one end of flexible air pressure hose 14 extends through line receipt aperture 23 at the first end of vacuum hose member 20 near its interconnection with vacuum cleaner 10, and such air pressure hose 14 extends down the inside of the vacuum hose member as will be described further below. Other equivalent means of passing the air pressure hose through the vacuum hose member can be utilized. The first end of air pressure hose 14 extends over to a source of compressed air such as air compressor tank 12. At the second end of vacuum hose member 20 is positioned collar member 22 onto which nozzle 24 is releasably secured.

Figure 2:
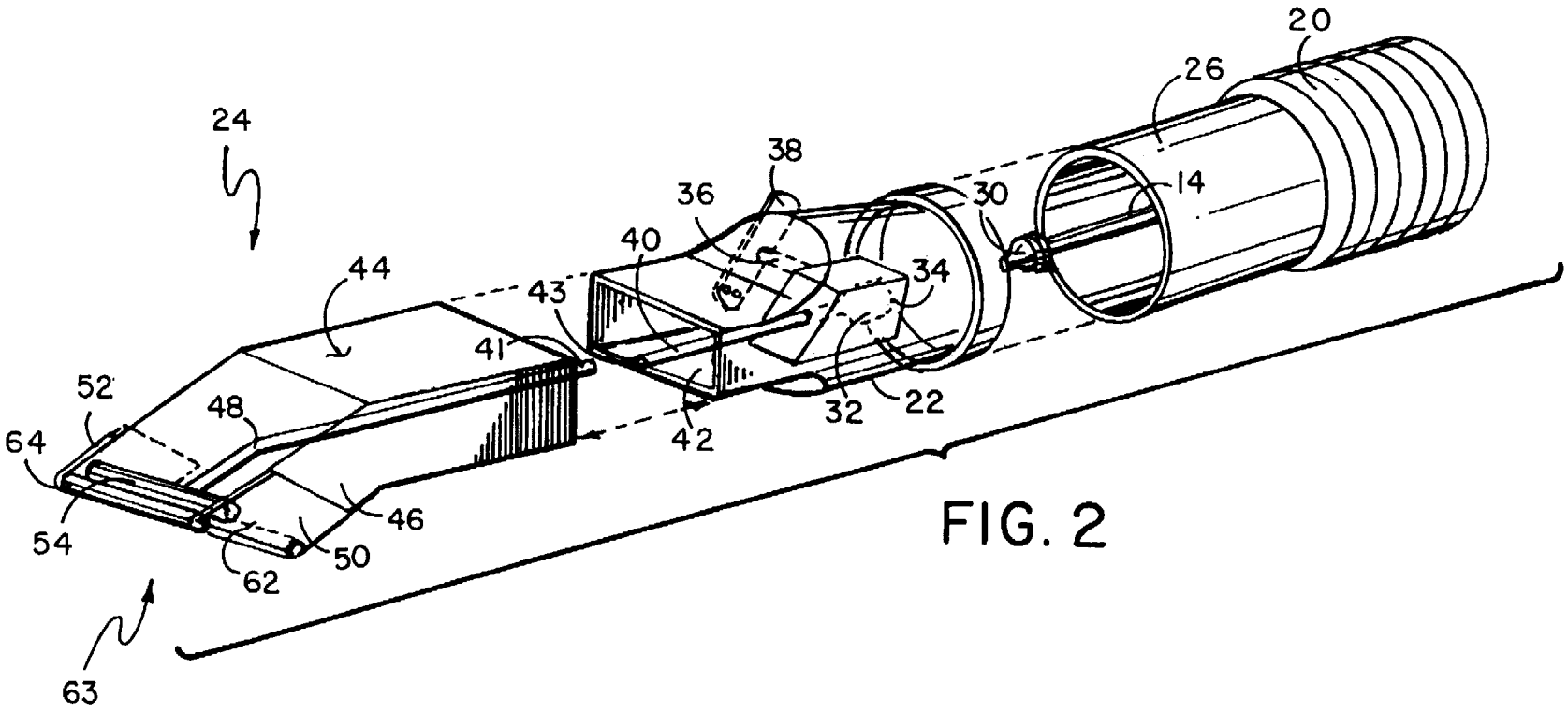
FIG. 2 illustrates a perspective view of the collar member showing its interconection at its first end with the end of the vacuum hose member and at its second end with the nozzle.

FIG. 2 illustrates a perspective view of collar member 22, vacuum hose member 20 and nozzle 24. Air pressure hose 14 extends down within vacuum hose member 20 ending with fitting 30. Within collar member 22 is contained valve member 34 which is an on/off valve for high-pressure air which has inlet 32 disposed at the first end thereof on which fitting 30 is attached, thereby joining the flexible air pressure hose 14 to valve member 34 after which collar member 22 is pushed onto hose end member 26 and held by a friction fit. Inlet 32 can be centrally disposed to receive fitting 30 so that collar 22 can be inserted on hose member 26 in any rotational position to most conveniently position valve trigger 38 for use. Equivalent means of attaching hose end member 26 to collar member 22 can be utilized. Valve actuator button 36 is actuated when valve trigger 38 is manually squeezed, depressing valve actuator button 36. Valve trigger 38 can be hinged on the outside of collar member 22 over valve actuator button 36 such that when it is desired to utilize high-pressure air, valve trigger 38 is manually depressed, thereby opening valve member 34. Equivalent means to activate/deactivate the valve member can also be utilized. The second end of collar ember 22 features a reduced size opening 42, and valve member 34 extends to valve outlet 40 which has valve aperture 43 defined therein adapted to receive high-pressure air inlet extension 41 which protrudes rearward from the first end of nozzle 24. Valve outlet 40 and high-pressure air inlet extension 41 can be centrally located, respectively, in collar opening 42 and the first end opening of nozzle 24 so that the nozzle can be rotated to be slid onto collar member 22 in either the orientation of the nozzle aimed upwards or downwards. As the first end of nozzle 24 is inserted over reduced size opening 42 of collar member 22 and held thereto by a friction fit or other type of attachment, high-pressure air inlet extension 41 fits within valve aperture 43 such that as nozzle 24 is pushed rearwards toward vacuum hose member 20 on collar member 22, high-pressure air inlet extension 41 passes into valve aperture 43 with a tight friction fit into valve outlet 40 to prevent air pressure leaks therefrom. High-pressure air then passes into nozzle high-pressure air line 48 which can be a relatively stiff, metal tube. Nozzle 24 can have a bend in it wherein generally straight portion 44 is disposed at the first end of the nozzle and portion 46 is disposed at an angle to portion 44 to facilitate the nozzle's use. Nozzle portion 46 has an axis defined along its linear direction. Nozzle high-pressure air line 48 can have a similar bend as it extends down to mouth 63 of the nozzle. Positioned transversely across mouth 63 of the nozzle and interconnected perpendicularly to the linear direction of high-pressure air line 48 is high-pressure outlet member 54. High-pressure air outlet member 54 has in the embodiment shown in FIG. 3 a plurality of outlet apertures 56 defined therein, in this instance six, which apertures in a preferred embodiment can each be approximately 0.05 inch in diameter to allow the escape of high-pressure air therefrom when valve member 34 is activated by manually depressing valve trigger 38. High-pressure air outlet member 54 extends from side to side within mouth 63. Mouth 63 can be not only formed generally perpendicular to the linear axis of the nozzle but also can be disposed at an angle to such axis so as to allow the nozzle to be manually held at a comfortable angle when moved over the contours of automobile floor carpeting. Rear and front rollers 62 and 64 are retained, respectively, just beyond the front and rear of mouth 63 of the nozzle and can roll on the surface being vacuumed such as carpeting, spacing the mouth of the nozzle, in one embodiment, a distance of approximately ¼ inch away from the surface which distance assists in providing for more air movement as high-pressure air blows out through outlet apertures 56 in high-pressure air outlet member 54 to loosen the dirt and debris which is then vacuumed up through nozzle 24 by the vacuum cleaner as described above.

The extremely small size of the nozzle mouth and the placement of the outlet apertures within the nozzle mouth are critical to the successful operation of the system of this invention. If the nozzle mouth were larger, it could not be successfully used to clean car interiors. While the nozzle mouth can be in a variety of shapes such as round or oval, a rectangular shaped mouth that is approximately 2¼ inches wide and 1 inch high has been found to work well.

Figure 3:
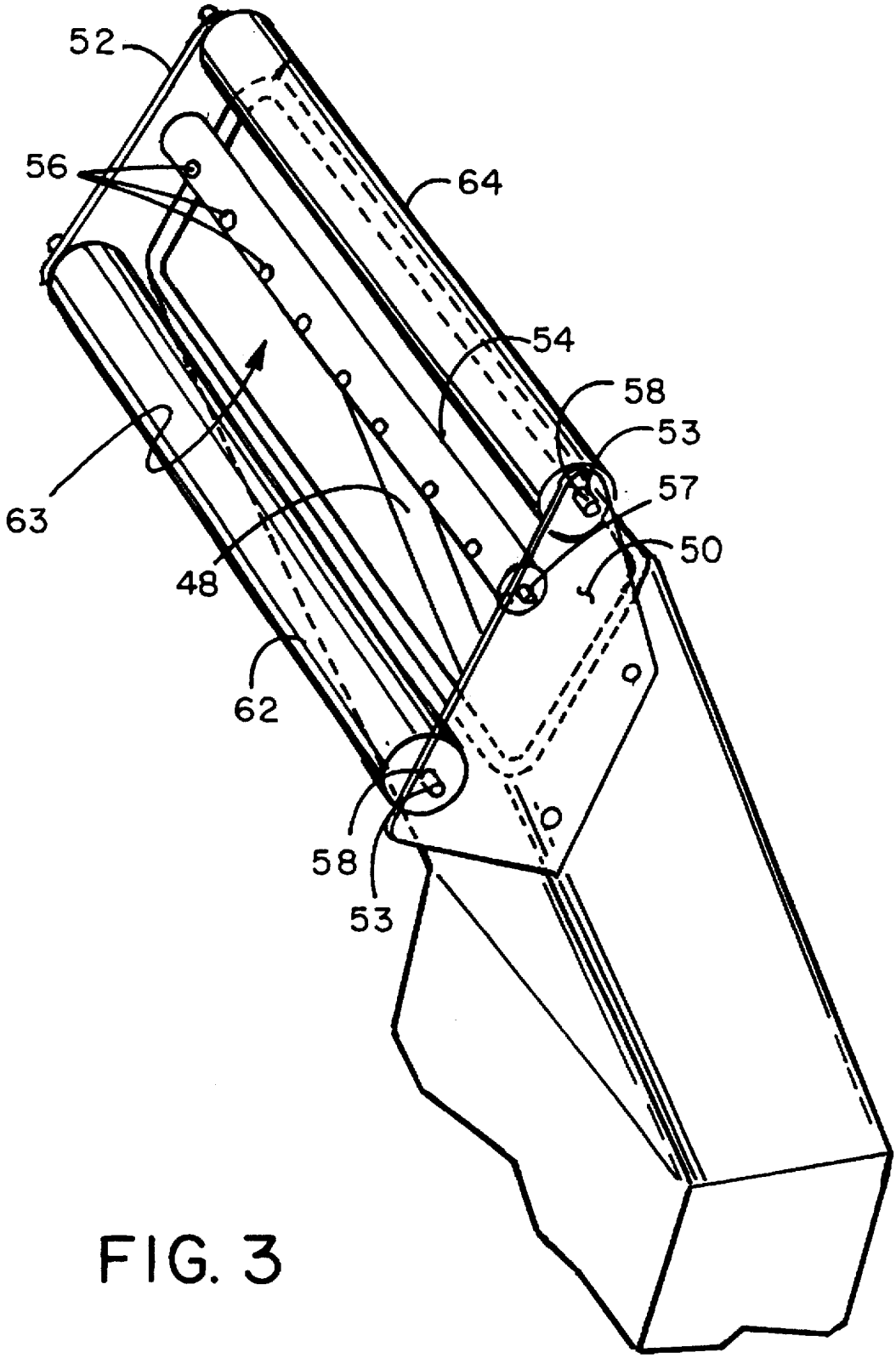
FIG. 3 illustrates a perspective view of one embodiment of the nozzle of this invention showing the high-pressure air outlet member disposed within the mouth of the nozzle.

As seen in FIG. 3, rear roller 62 and front roller 64 are retained, respectively, to nozzle 24 by first and second retention plates 50 and 52 which, for example, each have roller shaft apertures 58 to receive protruding roller shafts 53 at the ends of the rollers. First and second retention plates 50 and 52 are attached to nozzle 24 on each side of nozzle mouth 63, and depending on the positioning of such retention plate attachment the rollers are disposed closer or further away from nozzle mouth 63. Rollers 62 and 64 are rotatably retained in parallel alignment to the mouth opening angle such that front roller 64 is disposed away from the front side of the mouth the same distance that rear roller 62 is disposed away from the rear side of the mouth. The rollers protrude beyond the lower sides of the retention plates so that the nozzle can roll on the rollers when moved over the surface to be vacuumed. Front roller 64 not only protrudes below the retention plate at the bottom of the retention plate but also protrudes at the front of the retention plates so that it can roll onto objects that are in front of the nozzle as it moves. The retention plates can be riveted or otherwise attached to the sides of the nozzle. High-pressure outlet member 54 can be engaged to each side of the retention plates, as seen in FIG. 3, in a position such that it is disposed closer to front roller 64. Nozzle high-pressure air line 48 has some rotational movement because the pivotal type attachment 57 holding a shaft extension of the high-pressure outlet member 54 within each retention plate 50 and 52 allows it to rotate somewhat in relation to its retention to the first and second retention plates 50 and 52. This rotation of the high-pressure outlet member 54 allows the high-pressure air inlet extension 41, as seen in FIG. 2, to be movable at the rear opening of the nozzle upwards and downwards in its centrally disposed position to make it easier to position and align it to receive valve outlet 40 which slides therein when mounting the nozzle onto collar member 22. The rollers and retention plates can be made of stainless steel or equivalent.

Figure 4:
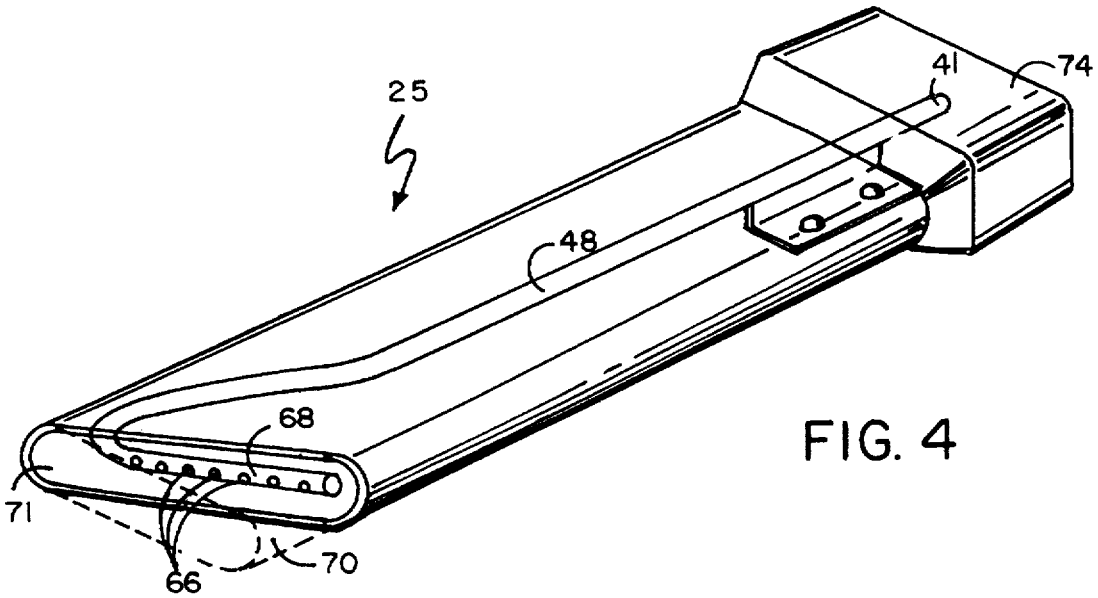
FIG. 4 illustrates a perspective view of a roller-less embodiment of the nozzle of this invention wherein high-pressure air outlet apertures are disposed at the end of an elongated, extremely narrow nozzle.

FIG. 4 illustrates an alternate embodiment of the nozzle having a similar interconnection structure to the collar member as that seen in FIG. 2. Since nozzle 25 is elongated and wheel-less, being narrower at its second end, a special insertion collar 74 is provided at its first end to fit around the second end of the collar member. The narrow, generally oval-shaped mouth of this embodiment of the nozzle is cut at angle 70 to its axis extending the length of the nozzle, and high-pressure air outlet member 68 is provided with seven outlet apertures 66 of similar diameter to the diameters of outlet apertures 56, seen in FIG. 3, such that the high-pressure air is also directed through mouth 71 of the nozzle of FIG. 4 to dislodge any debris in narrow areas to be vacuumed. In nozzle 25 the high-pressure air inlet extension 41 is also centrally located so that nozzle 25 can be mounted with its angular mouth facing either to the right or to the left depending on which positioning is most convenient to the user.

Figure 3A:
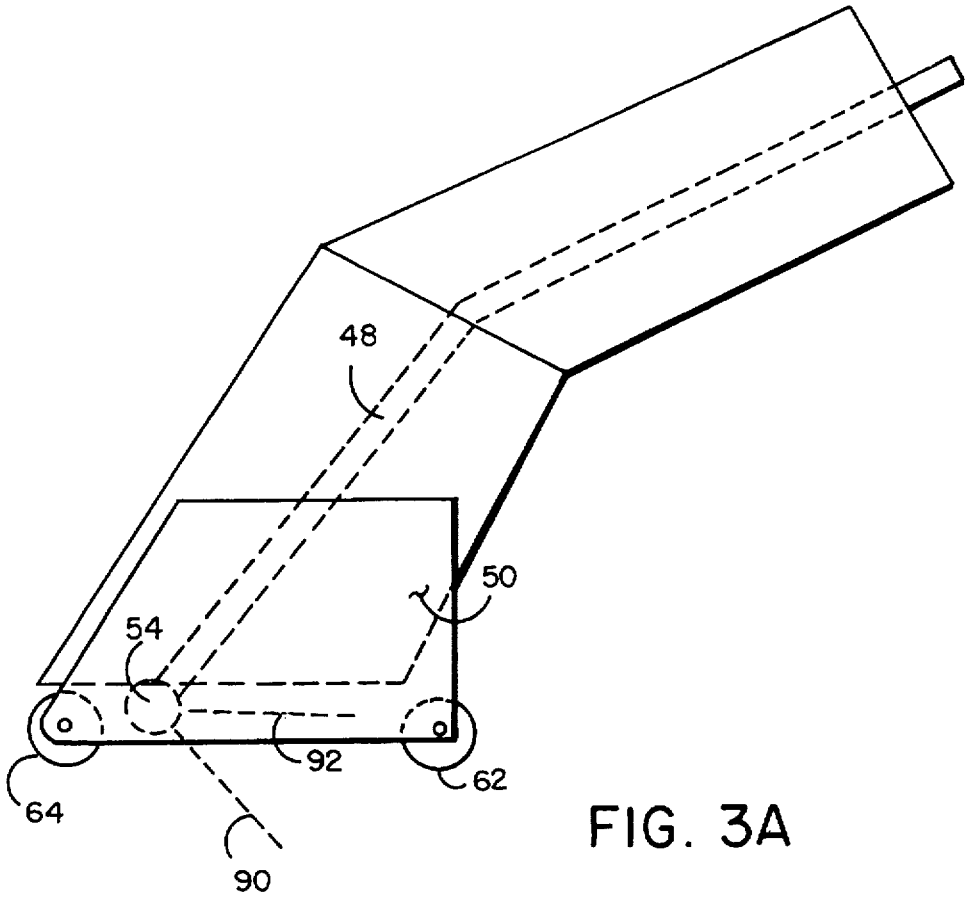
FIG. 3A illustrates a side view of one embodiment of the nozzle of this invention.
Figure 9:
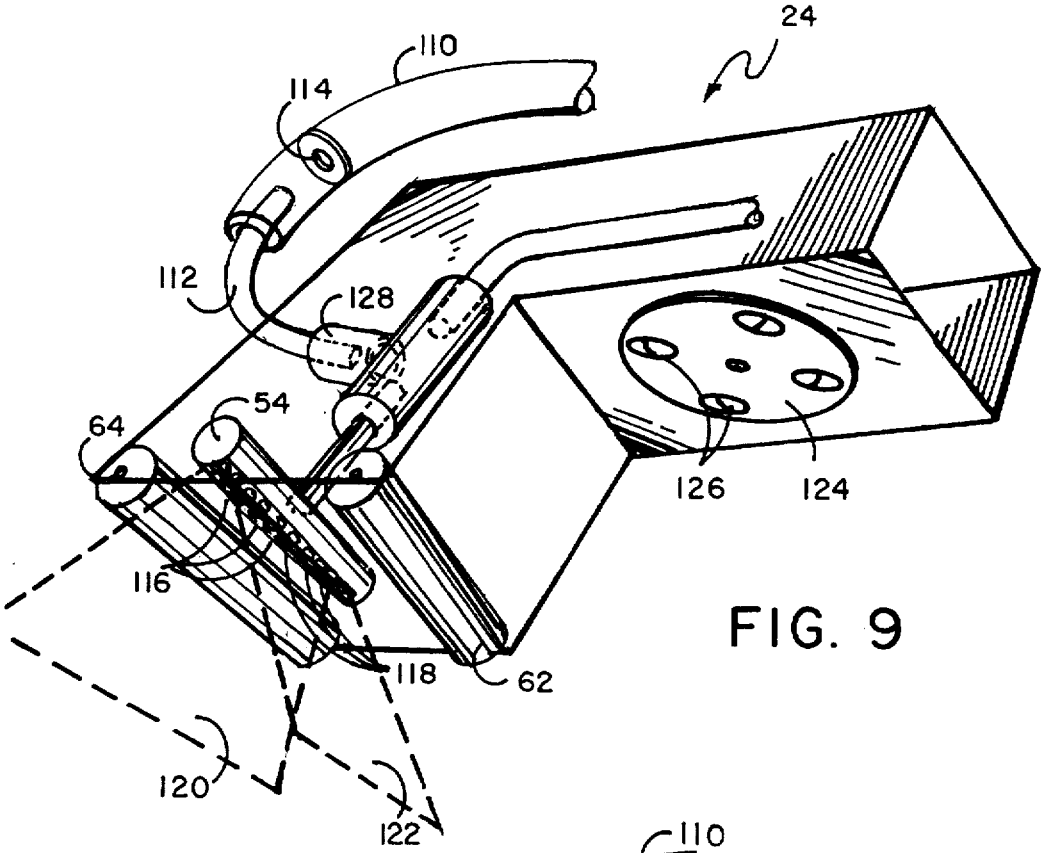
FIG. 9 illustrates a perspective view of a nozzle with an adjustable vent for delivery of shampoo fluid.

Many sizes, shapes and arrangements of outlet aperture(s) 56 can be utilized. In some embodiments an elongated slot can be utilized as an outlet aperture, being approximately 0.01 inch in height and of varying width, the use of which slot can help eliminate high-pressure air line marks on upholstery fabric when using the system of this invention. When a plurality of outlet apertures, such as four, are utilized, an outlet aperture diameter of 0.04 inch has been found preferable. In such preferred embodiment there is a usage of 3½ cfm at 100 psi per aperture, yielding in the range of 15–30 cfm of air pressure flow which rate can be maintained by most commercial air compressors found in professional automotive garages. It has been found that large commercial vacuum cleaners with 1½–2 peak horse power can move 125 cfm of air by vacuum suction through the extremely small nozzle utilized in this invention. In some embodiments the outlet apertures can be disposed to blow air at an angle to the plane of the mouth such as blowing air at a 45-degree angle which rearward directed air current is depicted by dotted lines 90 in FIG. 3A. A dual row of outlet apertures can also be utilized, such as seen in FIG. 9, with front outlet apertures 116 blowing air straight down in line with the nozzle and with rear outlet apertures 118 blowing at a 45 degree angle thereto, as discussed further below. The apertures can also be disposed to blow air in an almost parallel direction to such plane, as depicted by dotted lines 92 in FIG. 3A, which air blasts help loosen dirt particles and direct them up the vacuum nozzle. Other angles of air blasts can also be used.

Figure 5:
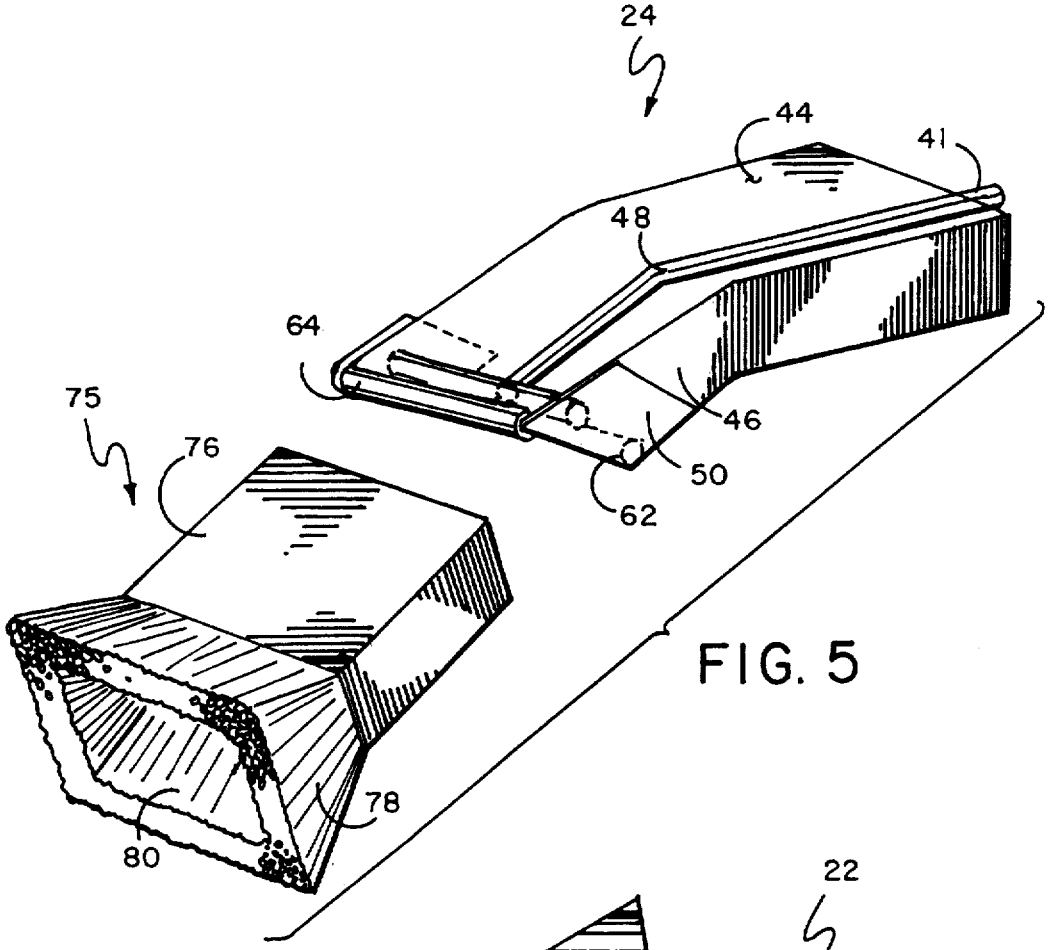
FIG. 5 illustrates a perspective view of the nozzle of FIG. 3 showing the placement of a brush attachment at the end thereof for the vacuuming of upholstery fabric.

FIG. 5 illustrates a perspective view of nozzle 24 of FIG. 3, showing brush attachment 75 composed of brush collar member 76 and brush member 78. Brush attachment member 75 in various embodiments can be passed over or into the second end of nozzle 24 and positions high-pressure air outlet member further away from the surface being vacuumed, such as fabric upholstery, so as to not disturb the nap of the upholstery. Brush attachment 75 also acts to loosen debris along with the high-pressure air passing through the outlet apertures which outlet apertures are now displaced further away from the surface being vacuumed.

Figure 6:
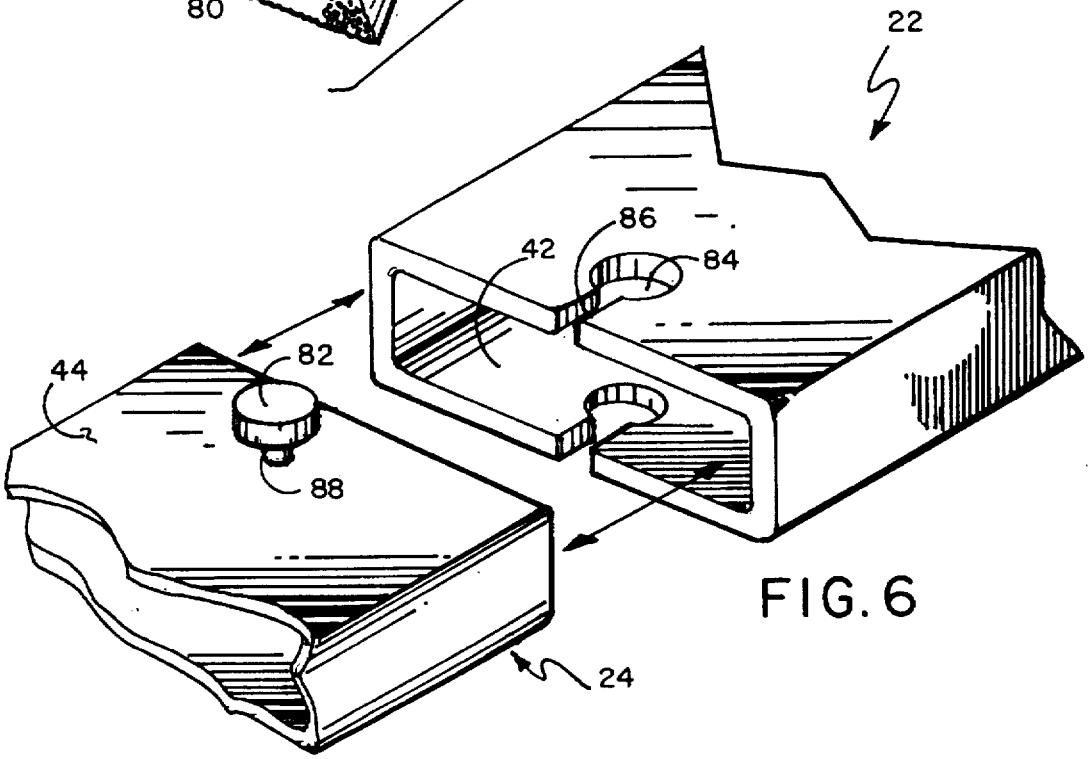
FIG. 6 illustrates a perspective view of one example of an interconnection structure for attaching the nozzle to the collar member.

FIG. 6 illustrates one embodiment of attachment means to attach portion 44 of nozzle 24 to collar member 22 showing portion 44 having protruding top member 82 supported on a narrow post 88 with a mating receipt slot channel 86 defined in collar member 22 which channel is somewhat narrower than post 88 to receive post 88. A similar post structure, not illustrated in this view, can also be positioned on the bottom of nozzle 24 to be received by a similar receipt slot channel. Nozzle 24 releasably attaches to collar member 22 by forcibly sliding post 88 within receipt slot channel 86 which force spreads the sides of channel 86 apart somewhat to receive the post. Collar member 22 can be composed of resilient plastic to allow receipt aperture 84 to close back around post 88 which is then held in position within receipt aperture 84 to hold and accurately position the nozzle on the second end of the collar member to retain it securely in position until the nozzle is deliberately pulled outward to disengage the post member(s) for removal when desired. Other equivalent means of attachment can be utilized such as friction-fit, as described above. Such attachment means must provide a secure attachment for the reliable exact positioning of the nozzle onto the end of the collar member.

Figure 7:
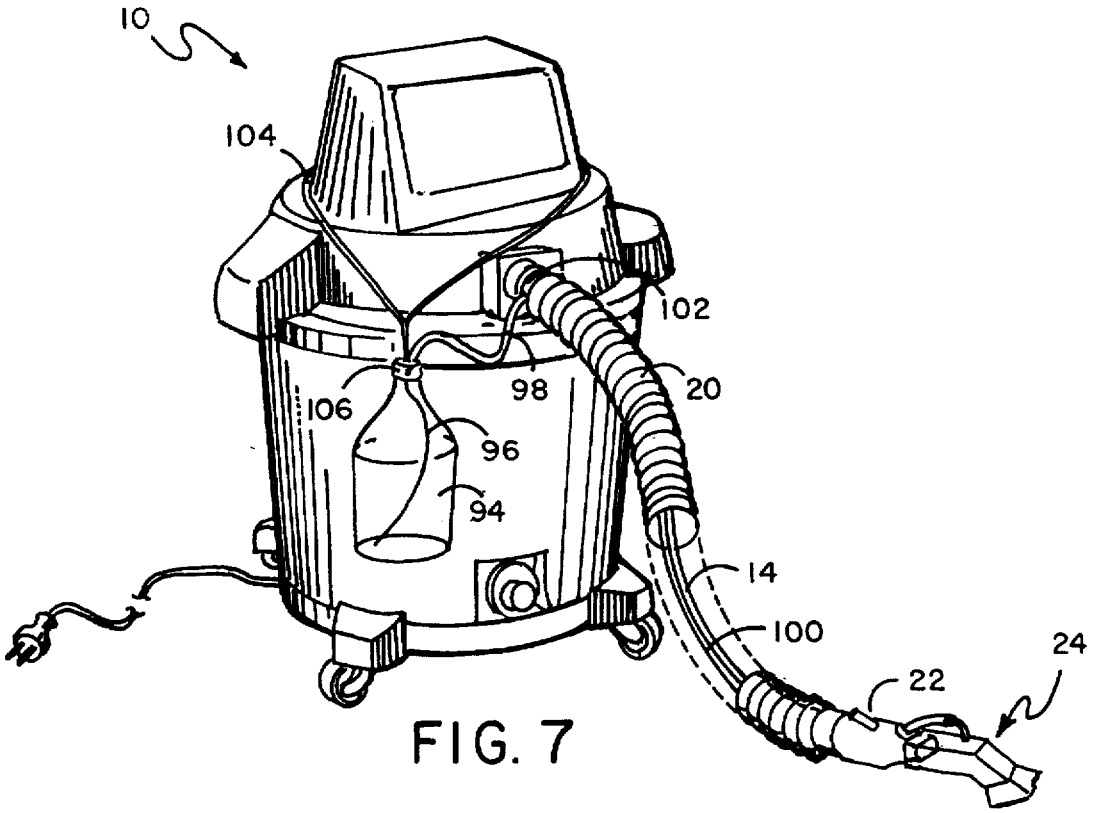
FIG. 7 illustrates a perspective view of the system of this invention with a bottle of shampoo fluid attached to the vacuum cleaner.
Figure 8:
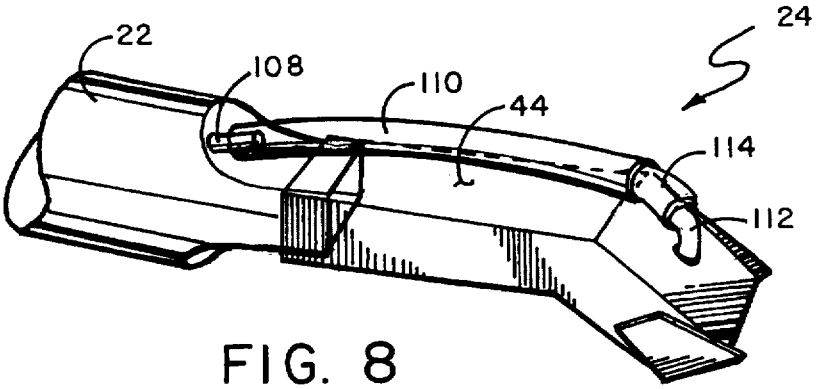
FIG. 8 illustrates a perspective view of the collar member and nozzle, showing the shampoo hose line entering the nozzle.

FIG. 7 illustrates a perspective view of the vacuum cleaning system of this invention incorporating the ability to also shampoo the fabric, carpet or other surface being cleaned. Seen in this view is vacuum cleaner 10 on which a container such as bottle 94 containing shampoo fluid is supported by strap 104 which extends around a portion of vacuum cleaner 10. Within bottle 94 extends tube 96 which goes below the surface of the shampoo fluid to near the bottom of the bottle and which extends through lid 106 as tube 98 which extends further through opening 102 in vacuum hose member 20. Once inside vacuum hose member 20, tube 98 extends further as shampoo-carrying tube 100 which extends alongside flexible air pressure hose 14 into collar member 22 where shampoo-carrying tube 100 then interconnects to outlet 108 which extends outward from a portion of collar member 22, as seen in FIG. 8. Outlet 108 is joined by extension tube 110 to inlet tube 112. A check valve 114 can be positioned in tube 110 to prevent any shampoo fluid from backing up within tube 110 which may occur when the high-pressure air flow is stopped.

FIG. 9 illustrates a perspective view of the nozzle showing the engagement of tube 110, containing check valve 114, onto inlet tube 112 which inlet tube 112 extends down to Join into nozzle high-pressure air line 48 at T-Junction 128. At this junction point the end of nozzle high-pressure air line 48 ends just below the entry of the inlet tube such that the air pressure blows by the end of inlet tube 112, creating a venturi effect. The venturi effect draws the shampoo fluid through tube 110 from shampoo tube 100, through tube 98 which extends to tube 96 in the bottle, such that the shampoo fluid is drawn into the high-pressure air flow when the air pressure is activated by trigger valve 38. Once within the high-pressure airstream within T-Junction 128, the shampoo fluid is directed forcefully out of the high-pressure outlet member 54, as seen in this view, which can in one embodiment have a dual set of air outlet apertures. Shown in FIG. 9 are front outlet apertures 116 which direct the air in a pattern 120 directly in line with the nozzle opening as well as the rear outlet apertures 118 which direct the air and shampoo fluid in an air stream pattern 122 which is directed at a rearward angle from the nozzle opening. In some nozzles the air vacuum force can be quite great at the nozzle opening, and an adjustable opening to decrease the force of the suction, such as openings 126, can be optionally provided with an adjustable air inlet member 124 which can be rotated thereover to either expose more or less of the openings 126. As openings 126 are exposed, the intensity of vacuum force will be reduced at the nozzle opening. As the adjustable air inlet member 124 is rotated in one direction, more and more of the apertures 126 are covered, causing an increase in the force of the vacuum at the nozzle opening located in the area between front roller 64 and rear roller 62.

Figure 10:
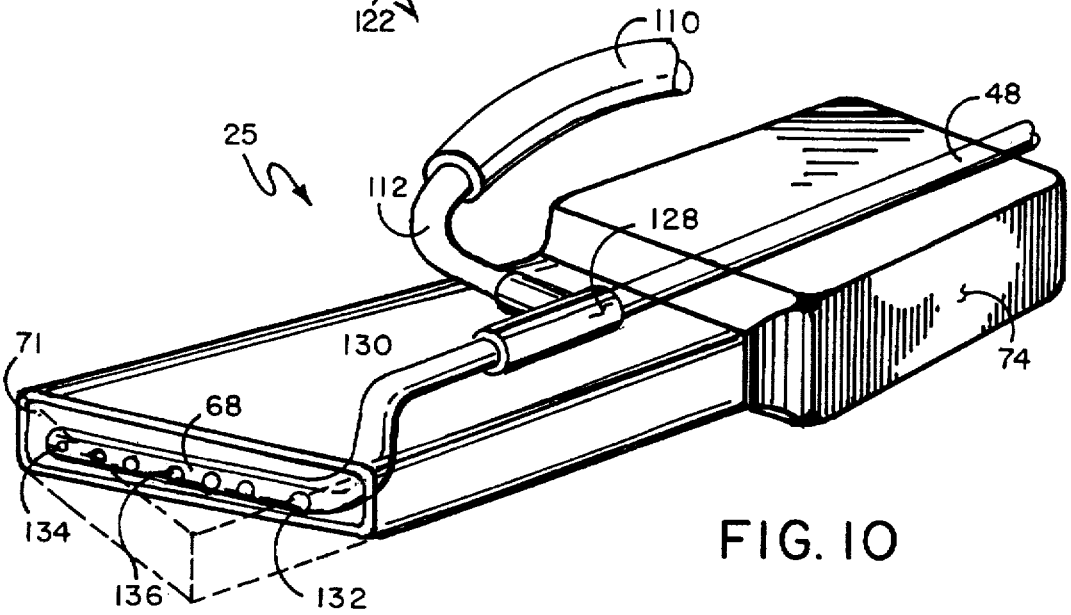
FIG. 10 illustrates a perspective view of a narrow nozzle with a shampoo hose line and nozzle openings of successively smaller sizes.

Yet another embodiment of the nozzle is seen in FIG. 10. Tube 110 carrying the shampoo fluid connects to inlet tube 112 and enters narrow nozzle 25 which tube then enters through a T-member 128 such that the shampoo fluid is picked up by a venturi action at the end of nozzle high-pressure air line 48 within the T-member just below inlet tube 112, directing the shampoo fluid through curved nozzle pipe 130 to the narrow air outlet member 68 through a series of nozzle openings of decreasing size, such as large opening 132 through a series of smaller openings such as mid-size opening 136 and small opening 134, to help balance the air pressure flow in mouth 71 of the nozzle so that the air flow is even across the nozzle mouth. Thus the system of this invention can provide a shampooing capability useful for cleaning carpets, headliners, door panels and upholstery and even difficult-to-clean velours. The narrow nozzle is useful not only in cleaning crevices but also its ability to shampoo at the same time through such a very small nozzle head is particularly advantageous when cleaning automobile interiors.

Although the present invention has been described with reference to particular embodiments, it will be apparent to those skilled in the art that variations and modifications can be substituted therefor without departing from the principles and spirit of the invention.

I claim:

1. A vacuum cleaning system for cleaning a surface, said system of the type having: a vacuum cleaner producing a suction; a vacuum hose member having a diameter, a length, a first end connected to said vacuum cleaner and a second end, wherein the improvement comprises:

a nozzle member having an axis, an open first end, an open second end defining a mouth, said second end having a linear direction along its axis and a front side, a rear side, a first side, and a second side;

a collar member having an exterior surface, a first end and a second end, said first end of said collar member interconnected to said second end of said vacuum hose member, said second end of said collar member being of a shape to receive said first end of said nozzle member thereon;

means to produce high-pressure air;

a flexible air pressure hose having a diameter, a first end and a second end, said diameter of said air pressure hose being substantially smaller than said diameter of said vacuum hose member, said air pressure hose engaged at its first end to said means to produce high-pressure air to carry said high-pressure air therethrough;

a hose receipt aperture defined in said first end of said vacuum hose member, said hose receipt aperture receiving said second end of said air pressure hose therethrough, said air pressure hose extending inside said vacuum hose member along its length;

a valve member disposed within said collar member, said valve member having a first end and a second end, said valve member having an inlet defined at its first end and an outlet defined at its second end;

means to engage said air pressure hose to said inlet of said valve member at said second end of said vacuum hose member;

means to manually activate said valve member to either an "on" open mode or to an "off" closed mode, said activation means positioned on said exterior surface of said collar member;

a nozzle high-pressure air line having a first end and a second end, said nozzle high-pressure air line extending within said nozzle member from said first end of said nozzle member to said second end of said nozzle member;

means to engage said first end of said nozzle high-pressure air line to said outlet of said valve member at said second end of said collar member;

a high-pressure air outlet member disposed within, and transverse to, said mouth of said nozzle member, said high-pressure air outlet member having a first end and a second end, said high-pressure air outlet member having at least one outlet aperture defined therein facing outwards from said mouth of said nozzle member in the direction of said axis of said nozzle member; and said nozzle high-pressure air line interconnected to said high-pressure air outlet member, said system, when said valve member is activated to its "on" position, to direct said high-pressure air from said means to produce high-pressure air, through said air pressure hose, through said valve member, through said nozzle high-pressure air line, through said high-pressure air outlet member, and through said outlet aperture to direct said high-pressure air out said mouth of said nozzle member against said surface being cleaned at the same time that said vacuum cleaner is sucking air through said mouth of said nozzle member, through said collar member and through said vacuum hose member into said vacuum cleaner.

2. The system of claim 1 wherein said nozzle mouth is rectangular in shape being approximately 2¼ inches wide and approximately 1 inch high, said system further including a front roller and a rear roller, said front roller and said rear roller rotatably mounted, respectively, at said front side and rear side of said nozzle mouth to rotate, respectively, adjacent to said front side and said rear side of said nozzle mouth, said front roller and said rear roller extending outward a distance from said mouth of said nozzle member wherein said high-pressure air outlet member extends across said nozzle mouth parallel to and disposed between said front and rear rollers, but not extending out said distance from said nozzle mouth as said front and rear rollers.

3. The system of claim 2 wherein said front and rear rollers are disposed away from said mouth of said nozzle member a distance to position said mouth of said nozzle member approximately ¼ inch above said surface being cleaned.

4. The system of claim 2 further including a plurality of outlet apertures defined in said high-pressure air outlet member.

5. The system of claim 4 wherein said plurality of outlet apertures are defined in two rows along said high-pressure air outlet member, said first row of outlet apertures to blow said high-pressure air at a 45-degree angle to said surface being cleaned in the direction of said rear side of said nozzle mouth and said second row of outlet apertures to blow said high-pressure air directly in line with the direction of said axis of said nozzle member.

6. The system of claim 4 further including:

a container of shampoo fluid disposed in association with said vacuum cleaner;

a shampoo fluid hose having a first end, a second end and a diameter, said first end of said shampoo fluid hose extending into said shampoo fluid, said diameter of said shampoo fluid hose being substantially smaller than said diameter of said vacuum hose member, said shampoo fluid hose extending through said hose receipt aperture in said vacuum hose member and extending inside said vacuum hose member parallel to said air pressure hose with said second end of said shampoo fluid hose extending out said second end of said vacuum hose member and into said first end of said collar member and out of said exterior surface of said collar member;

a shampoo inlet pipe having a first end and a second end, said shampoo inlet pipe disposed extending from outside said nozzle member to inside said nozzle member, said first end of said shampoo inlet pipe connected to said second end of said shampoo fluid hose; and a T-shaped hose member having a first end, a second end and a third end, said nozzle high-pressure air line having an end with said nozzle high-pressure air line engaged to said first end of said T-shaped hose member, said end of said nozzle high-pressure air line disposed directly below and perpendicular to said second end of said T-shaped hose member, said second end of said shampoo inlet pipe connected to said second end of said T-shaped hose member, and said third end of said T-shaped hose member connected to said high-pressure air outlet member, said system to direct shampoo fluid from said container through said shampoo fluid hose drawn by a venturi effect at the end of said nozzle high-pressure air line, said venturi effect created by the movement of high-pressure air passing by said second end of said T-shaped hose member and shampoo inlet pipe, causing said shampoo fluid to be delivered through said high-pressure air outlet member onto the surface to be cleaned when said valve member Is manually activated to its "on" open mode.

7. The system of claim 1 further including a plurality of outlet apertures defined in said high-pressure air outlet member.

8. The system of Claim 1 further including:

a container of shampoo fluid disposed in association with said vacuum cleaner;

a shampoo fluid hose having a first end, a second end and a diameter, said first end of said shampoo fluid hose extending into said shampoo fluid, said diameter of said shampoo fluid hose being substantially smaller than said diameter of said vacuum hose member, said shampoo fluid hose extending through said hose receipt aperture in said vacuum hose member and extending inside said vacuum hose member parallel to said air pressure hose with said second end of said shampoo fluid hose extending out said second end of said vacuum hose member and into said first end of said collar member and out of said exterior surface of said collar member;

a shampoo inlet pipe having a first end and a second end, said shampoo inlet pipe disposed extending from outside said nozzle member to inside said nozzle member, said first end of said shampoo inlet pipe connected to said second end of said shampoo fluid hose; and a T-shaped hose member having a first end, a second end and a third end, said nozzle high-pressure air line having an end with said nozzle high-pressure air line engaged to said first end of said T-shaped hose member, said end of said nozzle high-pressure air line disposed directly below and perpendicular to said second end of said T-shaped hose member, said second end of said shampoo inlet pipe connected to said second end of said T-shaped hose member, and said third end of said T-shaped hose member connected to said high-pressure air outlet member, said system to direct shampoo fluid from said container through said shampoo fluid hose drawn by a venturi effect at the end of said nozzle high-pressure air line, said venturi effect created by the movement of high-pressure air passing by said second end of said T-shaped hose member and shampoo inlet pipe, causing said shampoo fluid to be delivered through said high-pressure air outlet member onto the surface to be cleaned when said valve member is manually activated to its "on" open mode.

* * * * *